United States Patent [19]

Kurachi et al.

[11] 4,401,395

[45] Aug. 30, 1983

[54] TYPEWRITER

[75] Inventors: Hisao Kurachi, Okazaki; Takeo Ito, Kuwana; Hiroshi Onoda, Kariya, all of Japan

[73] Assignee: Brother Kogyo Kabushiki Kaisha, Japan

[21] Appl. No.: 238,552

[22] Filed: Feb. 26, 1981

[30] Foreign Application Priority Data

Feb. 27, 1980 [JP] Japan ..... 55-23840

[51] Int. Cl.[3] ..... B41J 29/42

[52] U.S. Cl. ..... 400/697.1; 400/215

[58] Field of Search ..... 400/697.1, 215, 235.1

[56] References Cited

U.S. PATENT DOCUMENTS

| | | | |
|---|---|---|---|
| 2,886,162 | 5/1959 | Eissfeldt et al. | 400/215 |
| 3,154,183 | 10/1964 | Wolowitz | 400/697.1 |
| 3,397,767 | 8/1968 | Hobbs | 400/697.1 |
| 3,724,633 | 4/1973 | Korb et al. | 400/697.1 |
| 3,747,734 | 7/1973 | Norman et al. | 400/697.1 |
| 4,172,672 | 10/1979 | Oddicini et al. | 400/697.1 |

FOREIGN PATENT DOCUMENTS

| | | | |
|---|---|---|---|
| 1920010 | 4/1971 | Fed. Rep. of Germany | 400/697.1 |
| 615625 | 2/1980 | Switzerland | 400/697.1 |

*Primary Examiner*—William Pieprz

*Attorney, Agent, or Firm*—Leydig, Voit, Osann, Mayer & Holt, Ltd.

[57] ABSTRACT

The typewriter has a drive mechanism including a vibrating mechanism and a feeding mechanism for a correction ribbon. The vibrating mechanism has a pair of ribbon vibrators, a cam follower provided to one of the vibrators, an eccentric cam designed to make one complete revolution for each printing operation in response to depression of associated key, and a spring member for resiliently biasing the cam follower toward the peripheral surface of the eccentric cam. The feeding mechanism has a pair of spindles for carrying ribbon spools, a ratchet wheel mounted on one of the spindles and a feed lever connected to the other vibrator. Upon depression of a correction key for setting the ribbon vibrators to be actuatable, followed by depression of an alphanumeric key, the ribbon vibrators are actuated by rotion of the eccentric cam so that the correction ribbon is raised from its inoperative position to its operative position. When the correction ribbon is lowered from its operative position to its inoperative position, the feed lever is actuated in timing with the return stroke of the ribbon vibrators for feeding the correction ribbon a predetermined length.

3 Claims, 5 Drawing Figures

TYPEWRITER

BACKGROUND OF THE INVENTION

This invention relates to a typewriter and more particularly to a ribbon drive mechanism therefor including a ribbon vibrating mechanism and a ribbon feeding mechanism.

In most of conventional typewriters, ribbons such as an ink ribbon and a correction ribbon are carried by a pair of ribbon vibrators of the ribbon vibrating mechanism so as to be normally in an inoperative position dawnwards of a point of contact between a printing element and a platen. The ribbon vibrating mechanism is actuated in conjunction with operation of the printing element associated with a selected alphanumeric key, the ribbon being thus raised from its inoperative position to an operative position opposite to the printing position. The ribbon feeding mechanism is actuated in conjunction with printing operation of the printing element so that the ribbon may be fed in longitudinal direction intermittently. In the known typewriters of this kind, the ribbon vibrating mechanism and the ribbon feeding mechanism are actuated separately from each other in conjunction with operation of the printing element and hence a complicated mechanical coupling must be provided between the printing elements and the respective mechanisms. Moreover, these two mechanisms may not be actuated precisely in the predetermined timed relation to each other.

SUMMARY OF THE INVENTION

In view of the foregoing, the present invention has for its principal object to eliminate these defects inherent in the prior art.

In a preferred embodiment of the invention, a ribbon vibrating mechanism and a ribbon feeding mechanism for a correction ribbon are disclosed. The ribbon vibrating mechanism comprises a pair of ribbon vibrators connected to each other for shifting together and each having a guide member for the ribbon at its end, a cam follower provided to one of the vibrators, an eccentric cam designed to make one complete rotation for each operation of a printing element in response to depression of associated key, and a spring member adapted for urging the cam follower into engagement with the peripheral surface of the eccentric cam. The ribbon feeding mechanism comprises a pair of spindles each carrying ribbon spool about which the correction ribbon is wound, a ratchet wheel mounted on one of the spindles, a feed lever occasionally engageable with the ratchet wheel, and a connecting member provided between one of said ribbon vibrators and the feed lever for actuating the latter in conjunction with partial movement of the ribbon vibrator.

Thus, if the cam follower has been set to be rotatable upon depression of a correction key and thereafter the eccentric cam is rotated partially in response to depression of a selected alphanumeric key, the cam follower moves according to rotation of said cam so that the ribbon vibrators shift the correction ribbon from its inoperative position to its operative position. While the correction ribbon is being lowered in conjunction with return movement of the ribbon vibrators, the feed lever is actuated through the connecting member by one of the vibrators for driving the spindle in one rotational direction and thereby smoothly advancing increments of the ribbon.

DETAILED DESCRIPTION OF THE PREFERRED EMBODIMENT

Figure 2:
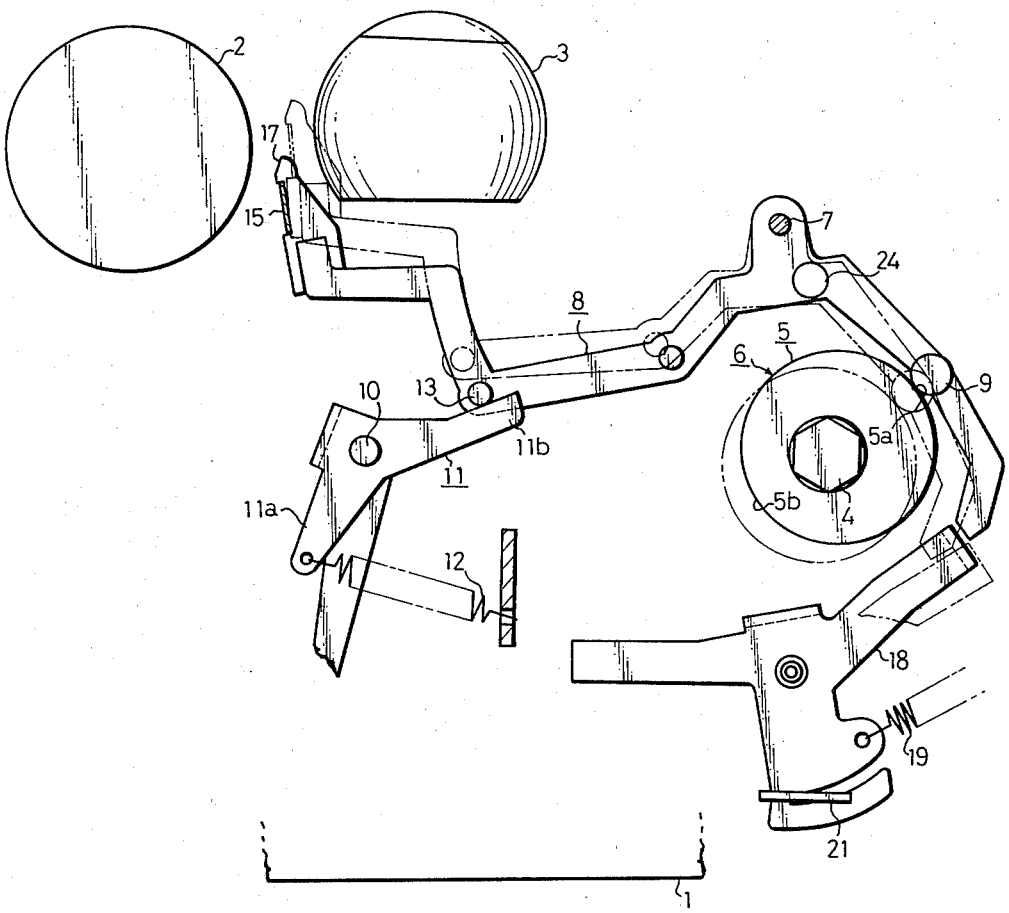
FIG. 2 is an enlarged left side view of a ribbon vibrating mechanism of the typewriter illustrated in FIG. 1.

As shown in FIG. 2, a platen 2 is mounted to the rear part of typewriter frame 1. A printing head 3, located in the front of the platen 2, has a number of types on its peripheral surface. Upon depression of an alphanumeric key (not shown), one of the types on the printing head 3 is selectively positioned, by a type selecting mechanism opposite to a printing position on the platen 2, and the printing head 3 is thereafter driven by a drive mechanism (not shown) towards the platen 2. A drive shaft 4 extends parallel to the platen 2 and is carried by the frame 1 for rotation about its own axis. The drive shaft 4 makes one complete revolution, for each depression of the alphanumeric key, by a drive mechanism and through a connecting mechanism including a gear 4*a*. It is noted that the type selecting mechanism, drive mechanism, connecting mechanism are known per se and described for instance in the U.S. Pat. No. 2,919,002.

Figures 1, 3:
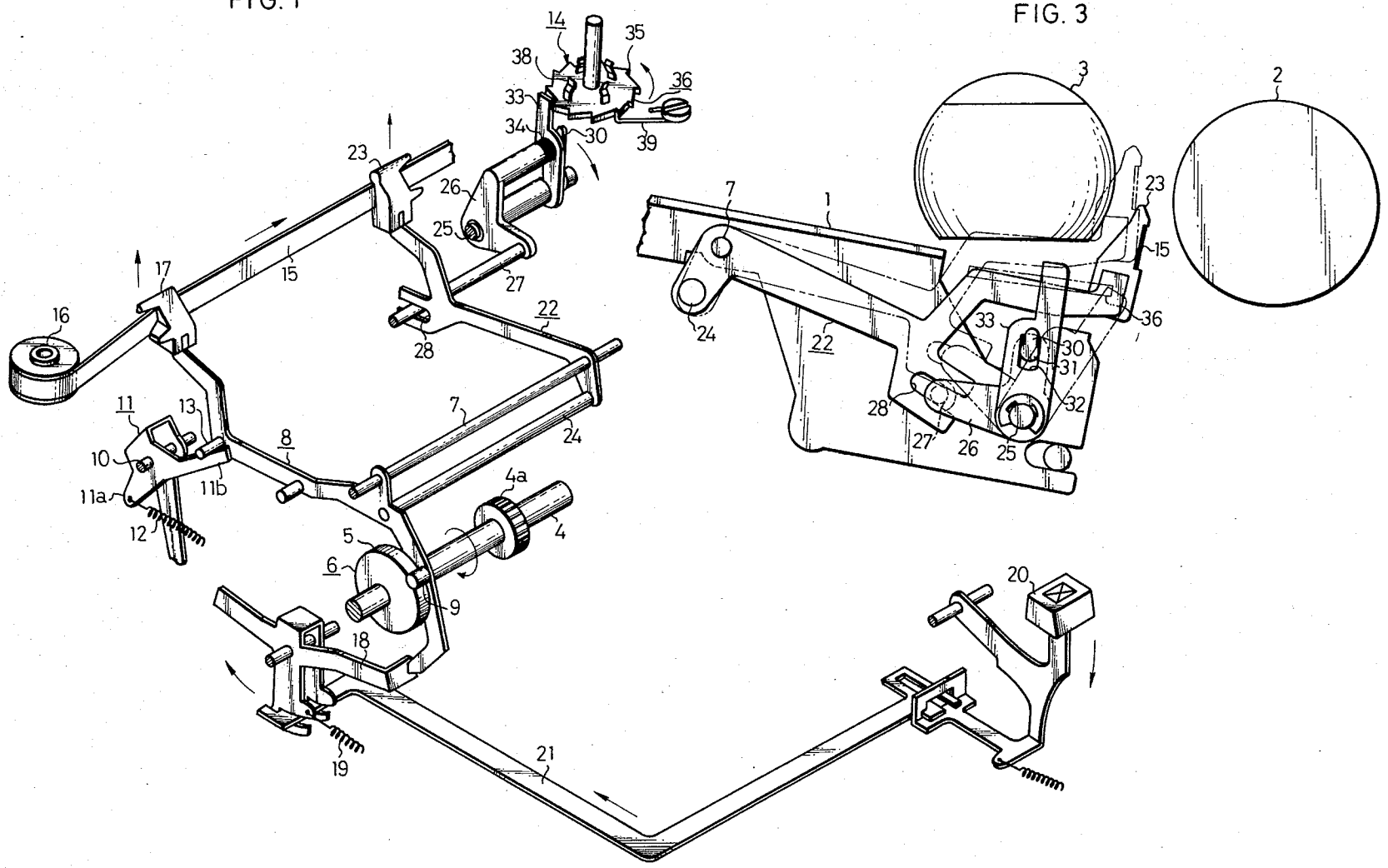
FIG. 1 is a perspective view of a typewriter embodying the present invention.
FIG. 3 is an enlarged right side view of the ribbon vibrating mechanism of the typewriter illustrated in FIG. 1.

An eccentric cam 6 is secured to said drive shaft 4 and has a cam surface 5 thereon. A shaft 7 is carried by the frame 1 for rotation about its own axis and extended parallel to said drive shaft 4 thereover. A left side vibrator 8, as viewed in FIG. 1, is rotatably secured, at a mid portion thereof, to the shaft 7 so as to be located at the left side of the printing head 3. A cam follower 9 in the form of a roll is provided to one side of the vibrator 8 for engaging with the cam surface 5 of the eccentric cam 6. A link lever 11 is pivotally mounted on a shaft 10 supported on the frame 1 and is positioned downwards of the vibrator 8. A spring 12 is anchored at one arm 11*a* of the link lever 11 and at the frame 1, the other arm 11*b* of the link lever 11 being thus engaged with a pin 13 provided on the vibrator 8. In this way, the vibrator 8 is urged ordinarily to be shifted clockwise as viewed in FIG. 2 so that the cam follower 9 is resiliently biased into engagement with the cam surface 5 of the cam 6 and the vibrator 8 shifts according to rotation of the cam 6.

A pair of spindles 14 are mounted on the frame 1 for carrying ribbon spools 16 for a correction ribbon 15. A guide member 17 for guiding the correction ribbon 15 along the platen 2 is provided on the end of the other side of the vibrator 8. When the cam follower 9 engages with the largest radius portion 5*a* of the cam surface 5 of the eccentric cam 6, the guide member 17 is kept at an inoperative rest position below a point of contact between the printing head 3 and the platen 2, as shown in solid line in FIG. 2. On the other hand, when the cam follower 9 engages with the smallest radius portion 5*b* of the cam surface 5 according to the partial rotation of the cam 6, the guide member 17 is raised to an operative position opposite to the point of contact, as shown in dot and dash line in FIG. 2.

A lever 18 is pivotally mounted on the frame 1 for occasionally engaging with or disengaging from the end of the one side of the vibrator 8. The lever 18 is normally kept by a spring 19 in the position shown in solid line in FIG. 2 for inhibiting the vibrator 8 from shifting according to the cam 6. Upon depression of a correction key 20, the lever 18 is moved through a connecting lever 21 from the position shown in solid line to the position shown in dot and dash line in FIG. 2, to permit the vibrator 8 to shift.

A right side vibrator 22 as viewed in FIG. 1 is secured to the shaft 7 so as to be located at the right side of the printing head 3. As shown in FIG. 3, a guide member 23 is provided on the end of the vibrator 22 for guiding the ribbon 15 along the platen 2 in cooperation with a similar guide member 17 of the vibrator 8. Two vibrators 8 and 22 are connected to each other through a rod 24 for shifting together. Thus, the guide members 17 and 23 on the two vibrators 8 and 22 may be integrally raised or lowered and thereby the correction ribbon 15 may be moved between an inoperative position and an operative position.

The typewriter has a printing ribbon (not shown) which is carried by means of another vibrating mechanism and raised from its inoperative position to its operative position in response to print operation.

As shown in FIGS. 1 and 3, a bifurcate lever 26 is positioned to the right side of the vibrator 22 and rotatably secured at its mid protion to a pivot 25 on the frame 1. A pin 27 is mounted to one end of the lever 26 and received in a bifurcate portion 28 of the vibrator 22, and therefore the lever 26 may be reciprocated according to shifting of the vibrator 22. A feed lever 33 having a slot 32 is mounted on the pivot 25 for rotation and tilting. The arm 31 is provided on the other end of the lever 26 and introduced into the slot 32 so that its flattened portion 30 abuts on the side of the feed lever 33. A spring 34 is mounted around the arm 31 for normally urging the feed lever 33 toward the position shown in dot and dash line in FIG. 4. Thus, when the vibrator 22 is shifted downwards from its operative position shown in dot and dash line to its inoperative position shown in solid line in FIG. 3, the feed lever 33 swings counterclockwise from the position shown in dot and dash line in FIG. 3.

Figure 4:
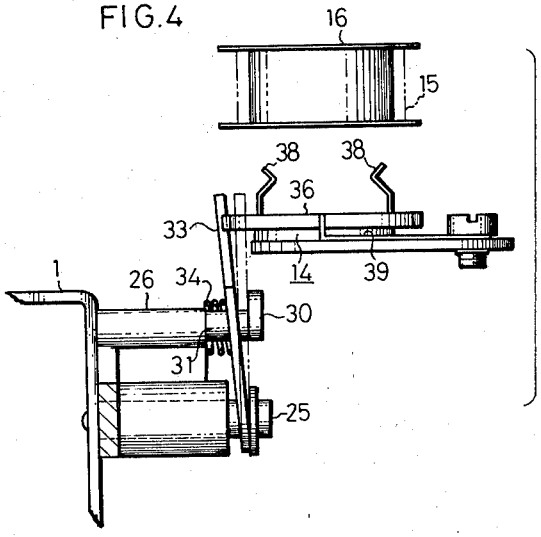
FIG. 4 is an enlarged front view showing of a ribbon feeding mechanism of the typewriter illustrated in FIG. 1.
Figure 5:
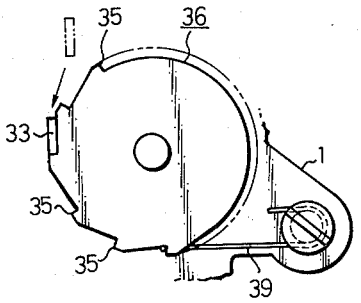
FIG. 5 is a plan view of a portion of the ribbon feeding mechanism illustrated in FIG. 4.

As shown in FIGS. 1, 4 and 5, a ratchet wheel 36 mounted on the spindle 14 in right side has a plurality of teeth 35, and is caused to rotate by a pitch corresponding to one character size when the feed lever 33 swings according to downward shifting of the vibrator 22. A leaf spring 38 mounted on the ratchet wheel 36 is adapted for holding the right side ribbon spool 16 for the correction ribbon 15. Thus, the correction ribbon 15, supplied from the left side spool 16, is taken up on the right side spool 16 by way of the guide members 17 and 23 of the vibrators 8 and 22. The numeral 39 designates a wire spring for preventing the ratchet wheel 36 from reversely rotating.

The typewriter so far shown and described operates as follows. If none of the alphanumeric keys are depressed, the various elements of the typewriter are kept in the position shown in solid line in FIG. 2. In this state, the eccentric cam 6 is in its rest position, with the cam follower 9 of the vibrator 8 engaging with the largest radius portion 5*a* of the cam surface 5, and the guide members 17 and 22 are caused to be in their inoperative position so that the correction ribbon 15 therebetween, is in its inoperative position below the printing position.

When the correction key 20 is depressed, the lever 18 is moved to the position shown in dot and dash line in FIG. 2 to permit partial rotation of the vibrators 8 and 22. In this state, as upon depression of the selected alphanumeric key, the drive shaft 4 and hence the eccentric cam 6 mounted fixedly thereon are driven into partial rotation, the cam follower 9 and vibrator 8 are moved by the force of the spring 12 according to rotation of the cam 6 and soon the cam follower 9 engages with the smallest radius portion 5*b* of the cam surface 5. Therefore the vibrators 8 and 22 are caused to shift from the position shown in solid line to the position shown in dot and dash line in FIGS. 2 and 3, and the guide members 17 and 23 thereon are brought to their elevated operative positions. Hence, the correction ribbon 15, mounted between these guide members 17 and 23, is also brought to its operative position. Immediately thereafter, the printing head 3 strikes through the correction ribbon 15 against a record medium (not shown) on the platen 2 for erasing a character previously printed on the medium.

Thereafter, when the cam 6 is further rotated away from the position shown in dot and dash line in FIG. 2, two guide members 17 and 23 and the correction ribbon 15 therebetween start to be lowered. At this time, the feed lever 33 is driven by the lever 26 counterclockwise from the position shown in dot and dash line in FIG. 3 and engages with one ratchet tooth 35 on the ratchet wheel 36 in the midst of its movement as shown in FIG. 5. Thereafter the lever 33 is further driven to be tilted in engagement with the the tooth 35 on the ratchet wheel 36 against the resilient force of the spring 34, so that the ratchet wheel 36 is caused to rotate in the direction for advancing the correction ribbon 15 by one feed pitch. It is noted that, unless the feed lever 33 is allowed to tilt, the ratchet wheel 36 will interfere with the feed lever 33 for driving the ratchet wheel 36.

In the typewriter of the present embodiment, the correction ribbon 15 is advanced by one feed pitch when the cam follower 9 shifts against the force of the spring 12 from the position supported by the smallest radius portion 5*b* to the position supported by the largest radius portion 5*a* of the eccentric cam 6 and therewith two vibrators 8 and 22 return from its operative position to its inoperative position. Thus, vertical movement of the vibrators 8 and 22 as well as feed of the correction ribbon 15 may be effected reliably with a smaller force. Generally, a resilient tension on the ribbon and the force requested for feeding the ribbon against such tension increase according to raising of the ribbon toward the printing position, so that the printing element is capable of exactly striking through the ribbon against the record medium. Therefore, if the above-mentioned feeding mechanism is designed to feed the ribbon according to raising thereof, a tension on the ribbon 15 surely increases more than feeding only and the force of the spring 12 must be increased more than in this invention for shifting the vibrators 8 and 22 and feeding the ribbon 15.

If, moreover, the ribbon 15 is advanced when the cam follower 9 shifts toward the position supported by the smallest radius portion 5*b* of the cam 6, such tension on the ribbon 15 may cause the cam follower 9 not to follow the cam 6 and to stop. As the result, the guide members 17 and 23 may not be moved upward and a character to be erased by using the correction ribbon 15 remains on the record medium.

In the typewriter of the present embodiment, the ribbon feeding mechanism is designed to advance the ribbon 15 in the course of shifting of the cam follower 9 from the position supported by the smallest radius portion 5*b* to the position supported by largest radius portion 5*a* of the cam surface 5. Thus, the cam follower 9 is raised in engagement with the cam surface 5 and hence the vibrators 8 and 22 may not be prevented from performing their vertical movements. Hence, the guide members 17 and 23 may be moved reliably between their operative and inoperative positions.

According to the present invention, as described above, the ribbon vibrators may be actuated by partial rotation of an eccentric cam caused by operation of a printing element relative to selective depression of an alphanumeric key, the ribbon being thereby raised to the operative position opposite to the printing position on the platen. The ribbon feeding mechanism is also actuated according to movement of the ribbon vibrators for feeding a predetermined length of the ribbon in one direction. In this way, the drive mechanism including the ribbon vibrating mechanism and the ribbon feeding mechanism may be simplified and, moreover, the movement of the ribbon both longitudinally and traversely may be carried out smoothly with preset timing.

In addition to the above embodiment, the present invention may also be applied to the ribbon drive mechanism for the printing ribbon.

What is claimed is:

1. A typewriter wherein a printing element strikes through a ribbon against a record medium mounted on a platen, and a ribbon drive mechanism drives said ribbon in response to operation of said printing element both longitudinally and transversely relative to a point of contact between said printing element and platen, said mechanism comprising:

a pair of spindles on which spools containing said ribbon may be mounted, a drive member movably mounted about one of said spindles for driving thereof in one rotational direction and thereby advancing increments of said ribbon, a cam fixed on a shaft rotated on each operation of said print element, the periphery of said cam including a smallest radius portion and a largest radius portion, a vibrator pivotally mounted and having a guide portion for guiding said ribbon and a cam follower engageable to the periphery of said cam for shifting said guide portion between a normal rest position and an elevated operative position at which said guide portion holds said ribbon to be struck by said printing element, a spring member for resiliently urging said vibrator to bias said cam follower toward said cam and to raise said guide portion by its resilient force from said rest position to said operative position when said cam is rotated between positions at which said largest radius portion and said smallest radius portion engage with said cam follower according to rotation of said cam, said guide portion being lowered to said rest position when said cam is rotated between positions at which said smallest radius portion and said largest radius portion engage with said cam follower against the force of said spring member, whereby raising of said vibrator is caused by said spring member and lowering of said vibrator is positively caused by engagement of said cam with said cam follower, and means for coupling said vibrator to said drive member in order to advance increments of said ribbon when said guide portion is lowered to said rest position from said operative position according to rotation of said cam.

2. A typewriter according to claim 1 wherein said mechanism further comprises means connectable to said vibrator for holding thereof at an inoperative position against the resilient force of said spring member in spite of rotation of said cam on each operation of said printing element, and manual operating means for releasing said vibrator from said last mentioned means so that said cam follower is capable of engaging with the periphery of said cam and said guide portion is raised to said operative position according to rotation of said cam.

3. A typewriter wherein a printing element strikes against a record medium mounted on a platen, and a correction mechanism operates for erasing a character previously printed on said medium by means of striking said printing element through a correction ribbon against said character, said mechanism comprising:

a pair of spindles on which spools containing said correction ribbon may be mounted, said correction ribbon being supplied from the spool on one of said spindles and being taken up by the spool on the other spindle on which a ratchet wheel is mounted, a feed lever movably mounted about said taking up spindle and occasionally engageable with said ratchet wheel for rotating thereof in one rotational direction and thereby advancing increments of said correction ribbon, means for preventing said ratchet wheel from rotating in the reverse direction, a cam fixed on a shaft rotated on each operation of said print element, the periphery of said cam including a smallest radius portion and a largest radius portion, a vibrator pivotally mounted and having a guide portion for guiding said correction ribbon and a cam follower engageable to the periphery of said cam for shifting said guide portion between a normal rest position and an elevated operative position at which said guide portion holds said correction ribbon to be struck by said printing element, a spring member for resiliently urging said vibrator to bias said cam follower toward said cam and to raise said guide portion by its resilient force from said rest position to said operative position when said smallest radius portion engages with said cam follower according to rotation of said cam, said guide portion being lowered to said rest position when said largest radius portion engages with said cam follower against the force of said spring member, whereby raising of said vibrator is caused by said spring member and lowering of said vibrator is positively caused by engagement of said cam with said cam follower, means for coupling said vibrator to said feed lever in order to advance increments of said ribbon when said guide portion is returned to said rest position from said operative position according to rotation of said cam, means connectable to said vibrator for holding thereof at an inoperative position against a resilient force of said spring member in spite of rotation of said cam on each operation of said printing element, and manual operating means for releasing said vibrator from said last mentioned means so that said cam follower is capable of engaging with the periphery of said cam and said guide portion is raised to said operative position according to rotation of said cam.

* * * * *